United States Patent [19]

Hauser et al.

[11] Patent Number: 4,732,789

[45] Date of Patent: Mar. 22, 1988

[54] FLAME-RESISTANT COTTON BLEND FABRICS

[75] Inventors: Peter J. Hauser, Greensboro; Benny L. Triplett, Pleasant Garden; Chumpon Sujarit, High Point, all of N.C.

[73] Assignee: Burlington Industries, Inc., Greensboro, N.C.

[21] Appl. No.: 923,965

[22] Filed: Oct. 28, 1986

[51] Int. Cl.[4] ..... B05D 3/02

[52] U.S. Cl. ..... 427/393.3; 427/337; 427/392

[58] Field of Search ..... 427/393.3, 337, 341; 8/195

[56] References Cited

U.S. PATENT DOCUMENTS

| | | | |
|---|---|---|---|
| 3,789,091 | 1/1974 | Anderson et al. | 260/927 R |
| 3,849,368 | 11/1974 | Anderson et al. | 260/45.8 R |
| 3,877,974 | 4/1975 | Mischutin | 427/428 |
| 3,897,584 | 7/1975 | Swidler et al. | 427/412 |
| 3,974,310 | 8/1976 | Mischutin | 427/390 |
| 4,078,101 | 3/1978 | Cole | 427/341 |
| 4,116,702 | 9/1978 | Rohringer et al. | 106/15 FP |
| 4,120,798 | 10/1978 | Mischutin | 428/921 |
| 4,145,463 | 3/1979 | Cole . | |
| 4,158,077 | 6/1979 | Mischutin | 427/381 |
| 4,166,897 | 9/1979 | Umetani et al. | 427/393.3 |
| 4,246,031 | 1/1981 | Elgal et al. | 106/18.4 |
| 4,348,306 | 9/1982 | Mischutin | 252/608 |
| 4,448,817 | 5/1984 | Benisek | 427/412 |
| 4,494,451 | 1/1985 | Cole | 427/341 |
| 4,494,951 | 1/1985 | Cole et al. | 427/341 |

OTHER PUBLICATIONS

W. A. Sanderson et al., Textile Research Journal, 40, 458, 217, (1970).

B. L. McConnell et al., Textile Research Journal, 49, 458, (1979).

R. Swidler et al., U.S. 4,134,722, Jan. 16, 1979.

Albright & Wilson Product Data Sheet.

Albright & Wilson Material Safety Data Bulletin.

*Primary Examiner*—Thurman K. Page

*Assistant Examiner*—L. R. Horne

*Attorney, Agent, or Firm*—Nixon & Vanderhye

[57] ABSTRACT

Polyester/cotton and nylon/cotton blends are rendered flame-resistant in a two step process in which a THP salt prepolymer condensate of urea is applied, exposed to ammonia, then oxidized to form a polymer network in the cotton fibers, and cyclic phosphonate ester or hexabromocyclododecane is applied to impart flame resistance to the nylon or polyester fibers. Flame-resistant cotton/synthetic blended fabrics having excellent hand and washfastness result.

12 Claims, No Drawings

FLAME-RESISTANT COTTON BLEND FABRICS

This invention relates to a process for imparting flame-retardant properties to cotton/synthetic fiber blends, specifically polyester/cotton and nylon/cotton blended fabrics. In its preferred form, it uses two flame-retardant chemicals or flame-retardant systems, one specific to the synthetic component and the other specific to the cotton component.

BACKGROUND OF THE INVENTION

Prior attempts to achieve acceptable flame-resistant polyester/cotton or nylon/cotton blends have not met with commercial success. None of the treatments is practical from the consumer point of view, producing fabrics that have a very stiff hand. This is because in order to achieve the requisite flame-resistant properties, a high chemical add-on is required. This add-on makes the fabric stiff, masks the color of the underlying fabric, and often imparts an acrid or unacceptable odor to the fabric. In addition, the performance of the flame-resistant fabrics is often unreliable.

Most of the previous work conducted on flame-resistant polyester/cotton or nylon/cotton blends used a single chemical system that was targeted for the cotton component of the blend. The approach was to "load" the fabrics with a flame retardant specific for cotton, for instance THPS [tetrakis-(hydroxymethyl)phosphonium sulfate]. It was not unusual with these earlier products to use from 30 to 35% of fixed chemical add-on in order for the polyester/cotton or nylon/cotton blend fabric to pass a bottom vertical flame test. Regrettably, however, the aesthetics of the finished fabrics were poor, as they have a very stiff hand and the appearance of a coated fabric. The add-ons used for these products were far in excess of the theoretically required amounts.

When THPS is applied to a polyester/cotton or nylon/cotton blend, flame resistance results. Since the THPS is specific to cotton, it does not react with the polyester or nylon content of the fabric but simply physically coats the synthetic component. As a result, after multiple launderings, that portion of the flame retardant surrounding the polyester or nylon fiber is partially lost. In consequence, it was not unusual to use as much as 5.5% phosphorus add-on for a polyester/cotton blend, at least initially, in order to result in the target 3% of fixed phosphorus after 50 launderings in hot water.

In the 1970's, polyester/cotton blends were flame retarded using tris-2,3-dibromopropyl phosphate ("Tris") in combination with THPS. However, "Tris" was found to be a carcinogen and was withdrawn from the market, so that there is no predominantly-polyester blend of polyester and cottom sold today that has been treated with flame-retardant chemicals. An object of the present invention is to produce acceptable flame-resistant polyester/cotton and nylon/cotton blends using multiple flame-retardant chemicals or chemical systems, and to employ processing conditions or adjuvants that produce a commercially acceptable, attractive product having good color and acceptable hand.

BRIEF DESCRIPTION OF THE INVENTION

The process of the present invention employs two flame-retardant (FR) systems, one specific to the synthetic component and the other specific to the cotton component of the synthetic/cotton blends being flame-retarded. With this approach, the amount of flame retardant, such as THPS, required to satisfy flame-resistance standards can be reduced significantly and the resulting fabrics have not only better flame resistance, but also better aesthetics. In the processes disclosed in more detail below, different flame-retardant chemicals are applied in separate processing steps. Processing conditions, especially temperatures and humidities, are carefully controlled in order to optimize the use of the flame-retardant chemicals and to ensure good fixation to the synthetic/cotton blends, even after several launderings.

The polyester/cotton blends treated in accordance with the present invention contain between 35% and 80% of polyester, the balance being cotton. The nylon/cotton blends contain between 10% and 65% nylon.

The term "polyester" is used in its usual sense to mean highly polymeric, essentially linear polyester resins made by the reaction of a dicarboxylic acid or ester with a diol in the presence of an esterification or ester interchange catalyst. Illustrative dicarboxylic acids are malonic, succinic, adipic, azelaic, maleic, fumaric, hydromuconic, isophthalic, terephthalic, and cyclohexane-dicarboxylic acids. Representative diols are ethylene glycol, propylene glycol, butylene glycol and 1,6-hexanediol. See U.S. Pat. No. 2,465,319 and U.S. Pat. No. 2,901,446. The common commercial polyester resins are polyethylene terephthalate and polyethylene terephthalate modified by inclusion of minor proportions of a different glycol or dicarboxylic acid during the polyesterification process. The polyester used in the working examples that follow was polyethylene terephthalate.

As used in this specification, the term "nylon" is used to describe a manufactured fiber in which the fiber-forming substances are long-chain synthetic polyamides having recurring polyamide groups (—CONH—) as an integral part of the polymer chain. These polyamides are formed from various combinations of diacids, diamines and amino acids. See generally Kirk-Othmer Encyclopedia of Chemical Technology, Vol. 16 (Interscience, New York, 2nd. ed., 1968) pp. 1–105.

The polyester/cotton and nylon/cotton fibrous materials which can be provided with a flame-retardant finish according to the invention can be in any desired stage of processing, i.e., they can be treated as woven or knitted fabrics, dyed or undyed, or as textiles which have already been further processed.

DETAILED DESCRIPTION OF THE INVENTION

Flame-resistant properties are imparted to the fabric in two distinct steps, one for the cotton component and the other for the synthetic (polyester or nylon) component. The order in which these steps are conducted is not critical; good results can be obtained when the cotton component of the blend is treated either first or second. With this in mind, the specific procedures of this process are now described.

I. Treating the Cotton Component of the Synthetic/Cotton Blend.

Flame-resistant properties are imparted to the cotton component of the synthetic/cotton blend by impregnating the fabric with an aqueous solution containing a pre-condensate of a carefully measured quantity of urea [$NH_2CONH_2$] and a tetrakis-(hydroxymethyl)phosphonium salt, referred to as THP, as THPS when the salt is the sulfate $[(HOCH_2)_4P^+]_2SO_4^=$ or THPC when the salt is the chloride; the oxalate and phosphate salts are also known. The THP salt/urea precondensate is applied to the fabric and dried to a specific moisture level. It is then reacted on the fabric with ammonia, usually ammonia gas, under controlled conditions to form an ammoniated flame retardant which, in turn, is oxidized, usually with hydrogen peroxide, to form a three-dimensional flame retardant polymer network within the cotton fiber structure. This process results in a fabric having a softer hand than other treatments, such as THPS/urea, which tends to stay on the outside of the fibers and stiffen the fibers and is more susceptible to removal by repeated laundering.

Currently there are two THP-based flame retardant systems marketed for this type of treatment. Pyroset TPO is a THPS/urea precondensate of tetrakis-(hydroxymethyl)phosphonium sulfate and urea available from American Cyanamid Co., while Retardol AC is a THPC/urea prepolymer condensate of tetrakis-(hydroxymethyl)phosphonium chloride and urea available from Albright & Wilson.

The process of imparting flame resistance to 100% cotton fabrics using THPC/urea (Retardol AC) is known as the PROBAN process as licensed by Albright & Wilson. The process itself is described in the following U.S. Pat. Nos. 4,078,101; 4,145,463; 4,311,855 and 4,494,951, all to Albright & Wilson, the disclosures of which are hereby incorporated by reference to the extent necessary to explain the THP salt/urea precondensate process. This process is considered effective and is widely promoted by at least two companies for imparting flame resistance to 100% cotton fabrics; it is not promoted nor advertised for polyester/cotton blends or nylon/cotton blends. The THP salt/urea precondensate process by itself is ineffective to adequately protect polyester/cotton blends containing more than about 35 to 40% polyester.

II. Flame Retardant Treatments for Polyester and Nylon. One of the following flame retardants may be used for the polyester or nylon component of the blend. Hexabromocyclododecane is available as CD-75 from Great Lakes Chemical and as Saytex HBCD from the Ethyl Corporation. It is sold primarily for use as a flame retardant for plastics, in part because of its poor solubility in solvents commonly used for textile processing. Thus, it has found little use in the textile industry. Hexabromocyclododecane melts at about 360° F. When applied as a dispersion to a polyester/cotton or nylon/cotton fabric at elevated temperatues above its melting point, and then cooled, hexabromocyclododecane fuses to the fiber, imparting the requisite flame-resistant properties to the fibers of the polyester or nylon.

Another flame retardant material used in accordance with the present invention specific for the polyester or nylon component of the fabric is a thermally stable cyclic phosphonate ester prepared by reacting alkyl-halogen-free esters with a bicyclic phosphite. As a class, there cyclic phosphonate esters are represented by one of the formulas:

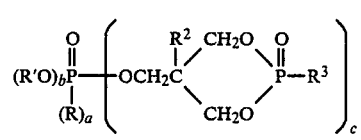

(A)

where a is 0 or 1; b is 0, 1 or 2, c is 1, 2 or 3 and a+b+c is 3; R and R′ are the same or different and are alkyl ($C_1$–$C_8$), phenyl, halophenyl, hydroxyphenyl, tolyl, xylyl, benzyl, phenethyl, hydroxyethyl, phenoxyethyl, or dibromophenoxymethyl; $R_2$ is alkyl ($C_1$–$C_4$); and $R^3$ is lower alkyl ($C_1$–$C_4$) or hydroxyalkyl ($C_1$–$C_4$) or

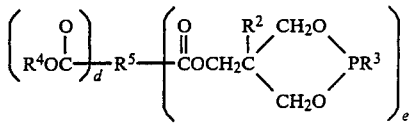

(B)

where d is 0, 1 or 2; e is 1, 2 or 3; $R^2$ is alkyl ($C_1$–$C_4$); $R^3$ is lower alkyl ($C_1$–$C_4$) or hydroxyalkyl ($C_1$–$C_4$); $R^4$ is alkyl ($C_1$–$C_4$) phenyl, halophenyl, hydroxyphenyl, hydroxyethyl, phenoxyethyl, dibromophenoxymethyl, tolyl, xylyl, benzyl or phenethyl; and $R^5$ is monovalent alkyl ($C_1$–$C_6$), chlorophenyl, bromophenyl, dibromophenyl, tribromophenyl, hydroxyphenyl, naphthyl, tolyl, xylyl, benzyl or phenethyl; divalent alkylene ($C_1$–$C_6$), vinylene, o-phenylene, m-phenylene, p-phenylene, tetrachlorophenylene (o, m, p), or tetrabromophenylene (o, m, or p); or trivalent phenyl.

The preferred compounds are represented by the formula:

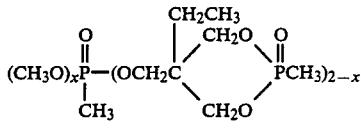

in which X is 0 or 1, and usually a 50:50 mixture of the mono- and di-esters. The preparation of these cyclic phosphonate esters and their use as flame retardants are described in U.S. Pat. Nos. 3,789,091 and 3,849,368, the disclosures of whioh are hereby incorporated by reference.

Antiblaze 19T, as described by the supplier Albright & Wilson Inc., of Richmond, Va., is a cyclic phosphonate ester, available as an odorless viscous liquid (viscosity 6000 SMS at 100° F.) with a flashpoint of 340° F. (ASTM D-93).

Hexabromocyclododecane, as described by its supplier Great Lakes Chemical Corporation of West Lafayette, Ind., is a cyclic alkyl bromide, empirical formula $C_{12}H_{18}Br_6$, CAS registry number 25637-99-4, composed of hexabromocyclododecane and related bromocycloalkanes. It is an odorless, water-insoluble, off-white powder having a melting point range of 288°–360° F. and is preferably used in the process of this invention as a dispersion in water or an aqueous pad bath system.

Tetrakis-(hydroxymethyl)phosphonium chloride/urea prepolymer condensate (THPC/urea) is available from Albright & Wilson, Inc., under the name Retardol AC. A related chemical, THPS/urea prepolymer condensate, is available from American Cyanamid Co., under the name of Pyroset TPO.

Flame Resistance Testing Methods—the following testing procedure was used:

FR Federal Test Method 5903 is intended for use in determining the resistance of cloth to flame and glow propagation and tendency to char. A rectangular cloth test specimen (70 mm×120 mm) with the long dimension parallel to the warp or fill direction is placed in a holder and suspended vertically in a cabinet with the lower end ¾ inch above the top of a Fisher gas burner.

A synthetic gas mixture consisting primarily of hydrogen and methane is supplied to the burner. After the specimen is mounted in the cabinet and the door closed, the burner flame is applied vertically at the middle of the lower edge of the specimen for 12 seconds. The specimen continues to flame after the burner is extinguished. The time in seconds the specimen continues to glow after the specimen has ceased to flame is reported as afterglow time; if the specimen glows for more than 30 seconds, it is removed from the test cabinet, taking care not to fan the glow, and suspended in a draft-free area in the same vertical position as in the test cabinet. Char length, the distance (in inches) from the end of the specimen, which was exposed to the flame, to the end of a lengthwise tear through the center of the charred area to the highest peak in the charred area, is also measured. Five specimens from each sample are usually measured and the results averaged.

As used throughout this specification and the claims that follow, all parts and percentages are expressed by weight and all temperatures reported in degrees F., unless otherwise indicated.

EXAMPLE 1A

Fabric style 9886 (50/50 nylon/cotton) was padded to a wet pickup of 61% with Pyroset TPO (THPS-urea precondensate from American Cyanamid; see bath formula), and heated at 130° F. for 48 seconds. The moisture content was found to be 15.5–16% as measured with a Mahlo meter. The fabric was equilibrated in a plastic bag for 1–2 hours. The fabric was then exposed to ammonia gas at 6:1 ammonia:phosphorus mole ratio. Oxidation of the fabric by a hydrogen peroxide/sodium silicate solution followed. The amount of peroxide used was 5% on the weight of fabric. The sodium silicate was used to maintain a pH of 9–9.5. The fabric was rinsed and tumble dried.

| Bath formula: | |
|---|---|
| Water | 30.6% |
| Aerosol C 61 wetting agent | 0.2% |
| Sodium acetate (60%) | 0.5% |
| Pyroset TPO | 68.7% |

The TPO/ammonia-treated style 9886 fabric was subsequently padded with a 15% Antiblaze 19 (Albright & Wilson) solution, heated in an oven at 380° F. for 45 seconds and tested for flame resistance as prepared and after 25 launderings.

| | FTM 5903 (Char Length) | |
|---|---|---|
| Fabric | 0 Laund. | 25 Laund. |
| 9886 + TPO/ammonia + AB19 | 2 in. | 4.5 in. |

EXAMPLE 1B

The TPO/ammonia-treated style 9886 fabric of Example 1A was also subsequently padded with a 15% dispersion of hexabromocyclododecane (HBCD), heated at 360° F. for 45 seconds, and tested for flame resistance as prepared and after 25 launderings.

| | FTM 5903 (Char Length) | |
|---|---|---|
| Fabric | 0 Laund. | 25 Laund. |
| 9886 + TPO/ammonia + HBCD | 2.75 in. | 2.75–3.0 in. |

None of the treated fabrics of Example 1A or 1B exhibited either afterflame or afterglow. The results show a high level of flame resistance, and the treated fabrics had satisfactory aesthetic properties.

EXAMPLE 2

In experiments similar to Example 1, 65/35 polyester/cotton fabric, style 9798, and 40/60 polyester/cotton fabric, style 9496, were padded with Pyroset TPO; see bath formula. The fabrics were dried to 16–16.5% moisture content, as measured with a Mahlo meter. The fabrics were then exposed to ammonia gas at a >6:1 ammonia:phosphorus mole ratio. Oxidation of the fabric by a hydrogen peroxide/sodium silicate solution followed. The amount of peroxide used was 5% on the weight of fabric. The sodium silicate was used to maintain a pH of 9–9.5. The fabric was rinsed and tumble dried.

| Bath Formula: | |
|---|---|
| Water | 52.5% |
| Aerosol C 61 wetting agent | 0.2% |
| Aerotex H softener | 2.0% |
| Sodium acetate | 0.3% |
| Pyroset TPO | 45.0% |
| **Fabric** | **Wet Pickup** |
| 9798 | 61% |
| 9496 | 63% |

Both TPO/ammonia-treated fabrics were subsequently padded with a 15% dispersion of hexabromocyclododecane (HBCD), heated at 360° F. for 45 seconds, and tested for flame resistance as prepared and after 25 launderings.

| | FTM 5903 (Char Length) | |
|---|---|---|
| Fabric | 0 Laund. | 25 Laund. |
| 9798 + TPO/ammonia + HBCD | 2.5 in. | 2.2 in. |
| 9494 + TPO/ammonia + HBCD | 2.0 in. | 2.0 in. |

None of the samples tested exhibited either afterflame or afterglow, and the low char lengths indicate a high level of flame resistance. The treated fabrics had a satisfactory hand and appearance.

We claim:

1. A two step process for imparting washfast flame resistance to a polyester/cotton or nylon/cotton blend fabric that remains after multiple launderings, the process comprising the steps of:

(a) applying to a polyester/cotton blend fabric containing between 35% and 80% polyester, balance substantially entirely cotton or a nylon/cotton blend fabric containing between 10% and 65% nylon, balance substantially cotton, a flame retarding amount of a prepolymer condensate of urea and a tetrakis-(hydroxymethyl)phosphonium salt flame retardant that fixes to the cotton fibers, exposing the prepolymer condensate-containing fabric to a source of ammonia to form an ammoniated prepolymer, then oxidizing the ammoniated prepolymer to form a flame-retardant polymer network within the cotton fiber structure; and (b) applying to the polyester/cotton or nylon/cotton blend fabric a flame retarding amount of (1) a cyclic phosphonate ester of (2) hexabromocyclododecane flame retardant that fixes to the polyester or nylon fibers and curing the fabric at elevated temperatures thereby fixing the applied cyclic phosphonate ester or hexabromocyclododecane to the polyester or nylon fibers.

2. The process of claim 1, in which step (a) is conducted prior to step (b).

3. The process of claim 1, in which step (b) is conducted prior to step (a).

4. The process of claim 1, in which the tetrakis-(hydroxymethyl)phosphonium salt is the chloride salt.

5. The process of claim 1, in which the tetrakis-(hydroxymethyl)phosphonium salt is the sulfate salt.

6. The process of claim 1, in which the tetrakis-(hydroxymethyl)phsophonium salt is the oxalate salt.

7. The process of claim 1, in which the tetrakis-(hydroxymethyl)phosphonium salt is the phosphate salt.

8. The process of claim 1, in which the cyclic phosphonate ester is represented by the formula:

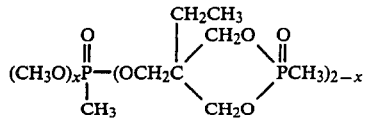

in which X is 0 or 1.

9. The process of claim 1, in which the flame retardant in step (b) is hexabromocyclododecane.

10. The process of claim 9, in which the hexabromocyclododecane is applied as an aqueous dispersion and is cured at a temperature of at least about 360° F. to melt and fuse the hexabromocyclododecane to the polyester or nylon fibers.

11. The process of claim 1, in which the fabric is a polyester/cotton blend.

12. The process of claim 1, in which the fabric is a nylon/cotton blend.

* * * * *